US010690450B2

(12) United States Patent
Levine et al.

(10) Patent No.: US 10,690,450 B2
(45) Date of Patent: Jun. 23, 2020

(54) BOMB DISPOSAL SUIT WITH BACK PROTECTOR

(71) Applicant: Med-Eng, LLC, Jacksonville, FL (US)

(72) Inventors: Jeff Levine, Napean (CA); Clint Hedge, Winchester (CA); Gordana Jeftic-Stojanovski, Ottawa (CA); Matthew Keown, Ottawa (CA); Dan Reddin, Ottawa (CA); Magda Slobozianu, Ottawa (CA); Rob Beland, Pickering (CA); Soeren Nielsen, Ottawa (CA); William Dicke, Gatineau (CA); Matthew Watson, Ottawa (CA)

(73) Assignee: Med-Eng, LLC, Jacksonville, FL (US)

( * ) Notice: Subject to any disclaimer, the term of this patent is extended or adjusted under 35 U.S.C. 154(b) by 1189 days.

(21) Appl. No.: 14/865,550

(22) Filed: Sep. 25, 2015

(65) Prior Publication Data

US 2017/0089669 A1 Mar. 30, 2017

(51) Int. Cl.

| | |
|---|---|
| ***F41H 1/02*** | (2006.01) |
| ***A41D 13/002*** | (2006.01) |
| ***A41D 13/05*** | (2006.01) |

(52) U.S. Cl.

CPC ..... *F41H 1/02* (2013.01); *A41D 13/0025* (2013.01); *A41D 13/0531* (2013.01); *A41D 2200/20* (2013.01); *A41D 2300/32* (2013.01); *A41D 2600/20* (2013.01)

(58) Field of Classification Search

CPC ..... A41D 13/0025; A41D 13/0531; A41D 2200/20; A41D 2600/20; F41H 1/02

See application file for complete search history.

(56) References Cited

U.S. PATENT DOCUMENTS

| | | | | |
|---|---|---|---|---|
| 5,564,124 | A | 10/1996 | Elsherif et al. | |
| 5,970,519 | A | 10/1999 | Weber | |
| 6,105,382 | A * | 8/2000 | Reason | A41D 13/005 165/46 |
| 8,365,312 | B2 | 2/2013 | Herring | |
| 8,533,872 | B1 | 9/2013 | Rodriguez | |
| 8,572,762 | B2 | 11/2013 | Hebener et al. | |
| 8,990,971 | B2 | 3/2015 | Carter | |
| 8,997,262 | B2 | 4/2015 | Klein | |

(Continued)

FOREIGN PATENT DOCUMENTS

| | | | |
|---|---|---|---|
| CN | 101627222 | A | 1/2010 |
| EP | 1994840 | A1 | 11/2008 |

(Continued)

OTHER PUBLICATIONS

European Patent Application No. 16190240.8; Extended European Search Report dated Nov. 9, 2016.

*Primary Examiner* — Alissa J Tompkins
*Assistant Examiner* — Brieanna Szafran
(74) *Attorney, Agent, or Firm* — Kane Kessler, P.C.; Paul E. Szabo; Barry E. Negrin

(57) ABSTRACT

A bomb disposal suit includes a jacket, trousers, and a back protector connected between the jacket and the trousers. The back protector includes a body of impact resistant material having a plenum with an intake opening to receive forced air and with outlet openings to direct forced air out of the plenum. A fan forces air into the intake opening. The back protector can transmit load vertically from the jacket to the trousers, for example, via a back plate.

12 Claims, 8 Drawing Sheets

(56) References Cited

U.S. PATENT DOCUMENTS

| | | | | |
|---|---|---|---|---|
| 2004/0083525 | A1* | 5/2004 | Wells, Jr. ..... | A41D 1/06 2/2.5 |
| 2005/0246826 | A1 | 11/2005 | McCarter | |
| 2007/0000001 | A1 | 1/2007 | Tomann et al. | |
| 2008/0141428 | A1 | 6/2008 | Kapah et al. | |
| 2010/0319381 | A1 | 12/2010 | Hubler et al. | |
| 2011/0179539 | A1 | 7/2011 | Dovner et al. | |
| 2012/0159680 | A1 | 6/2012 | Howland | |
| 2012/0180177 | A1 | 7/2012 | Learmont | |
| 2012/0185988 | A1 | 7/2012 | Hebener et al. | |
| 2013/0042376 | A1 | 2/2013 | Hexels | |
| 2013/0319031 | A1 | 12/2013 | Coats, IV | |
| 2014/0260939 | A1 | 9/2014 | Neal | |

FOREIGN PATENT DOCUMENTS

| | | | |
|---|---|---|---|
| WO | 2004084664 | A2 | 10/2004 |
| WO | 2005118167 | A2 | 12/2005 |
| WO | 2010035040 | A1 | 4/2010 |

* cited by examiner

BOMB DISPOSAL SUIT WITH BACK PROTECTOR

BACKGROUND OF THE INVENTION

A bomb disposal suit includes a jacket and trousers. The suit is designed to protect the wearer of the suit against overpressure, acceleration, fragmentation, and heat, in the event of an explosion. Because of the heavy protective construction of a bomb disposal suit, the wearer can become quite hot when wearing the suit. Also, the jacket, because it is so heavily configured for protection of the wearer, can place a substantial load on the shoulders of the wearer. In addition, the spinal area of the wearer must be protected with impact resistant material in the event the wearer is thrown backward onto the ground by the force of a blast.

DESCRIPTION OF AN EMBODIMENT OF THE INVENTION

Figure 1:
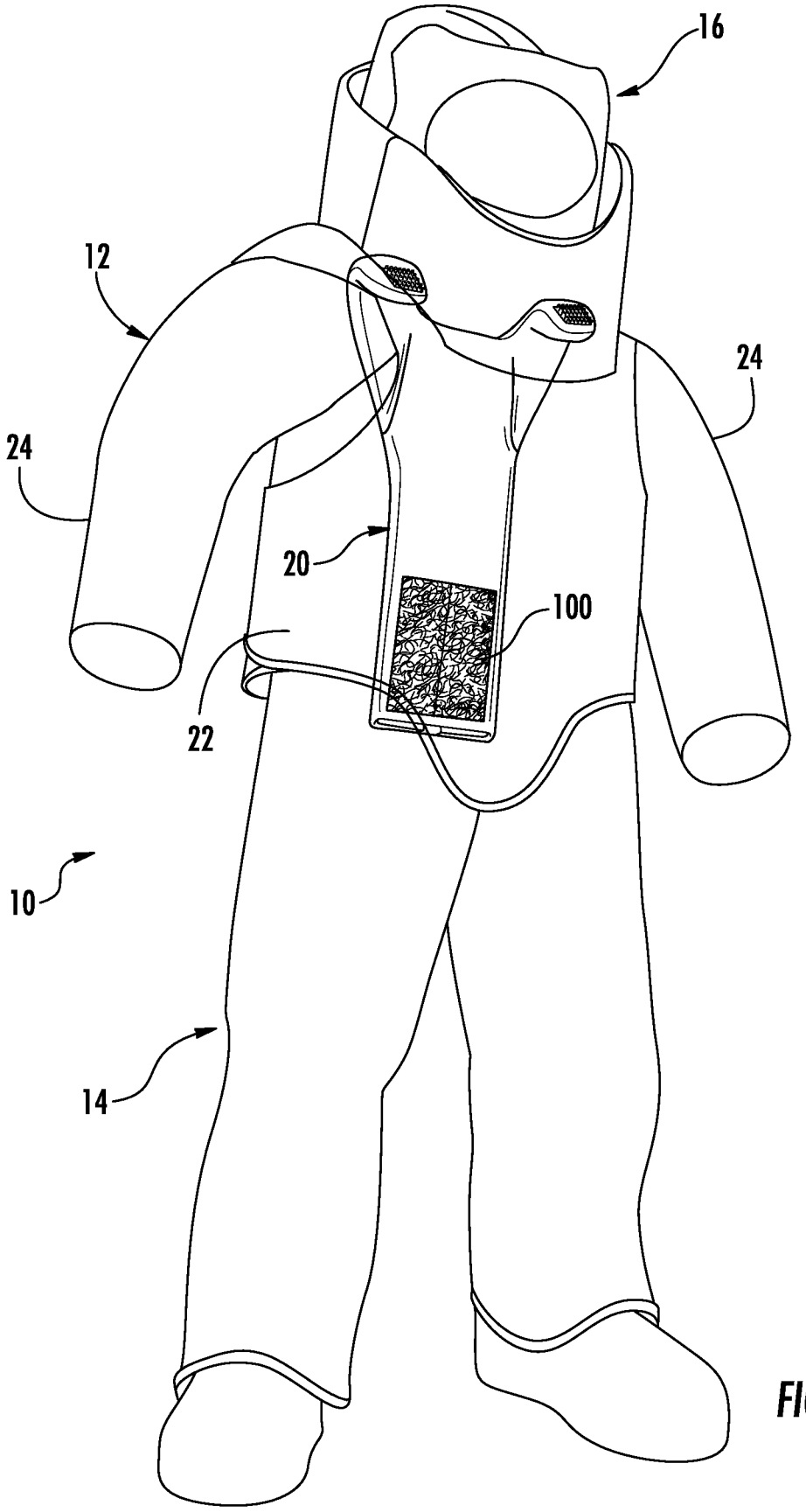
FIG. 1 is a schematic illustration of a bomb disposal suit that is an embodiment of the invention, including a jacket, trousers, and a back protector.

This invention relates to a bomb disposal suit with a back protector. The invention is applicable to bomb disposal suits and back protectors of varying constructions. As representative of the invention, FIG. 1 illustrates a bomb disposal suit 10 that is a first embodiment of the invention.

The suit 10 (FIG. 1) includes a jacket 12 and trousers 14. The suit 10 also includes a helmet indicated schematically at 16, and a back protector 20. The back protector 20 (FIG. 3), described below in detail, includes four major elements: a cover 50, a body of impact resistant material 52, a fan assembly 54, and a back plate 56.

Figure 2:
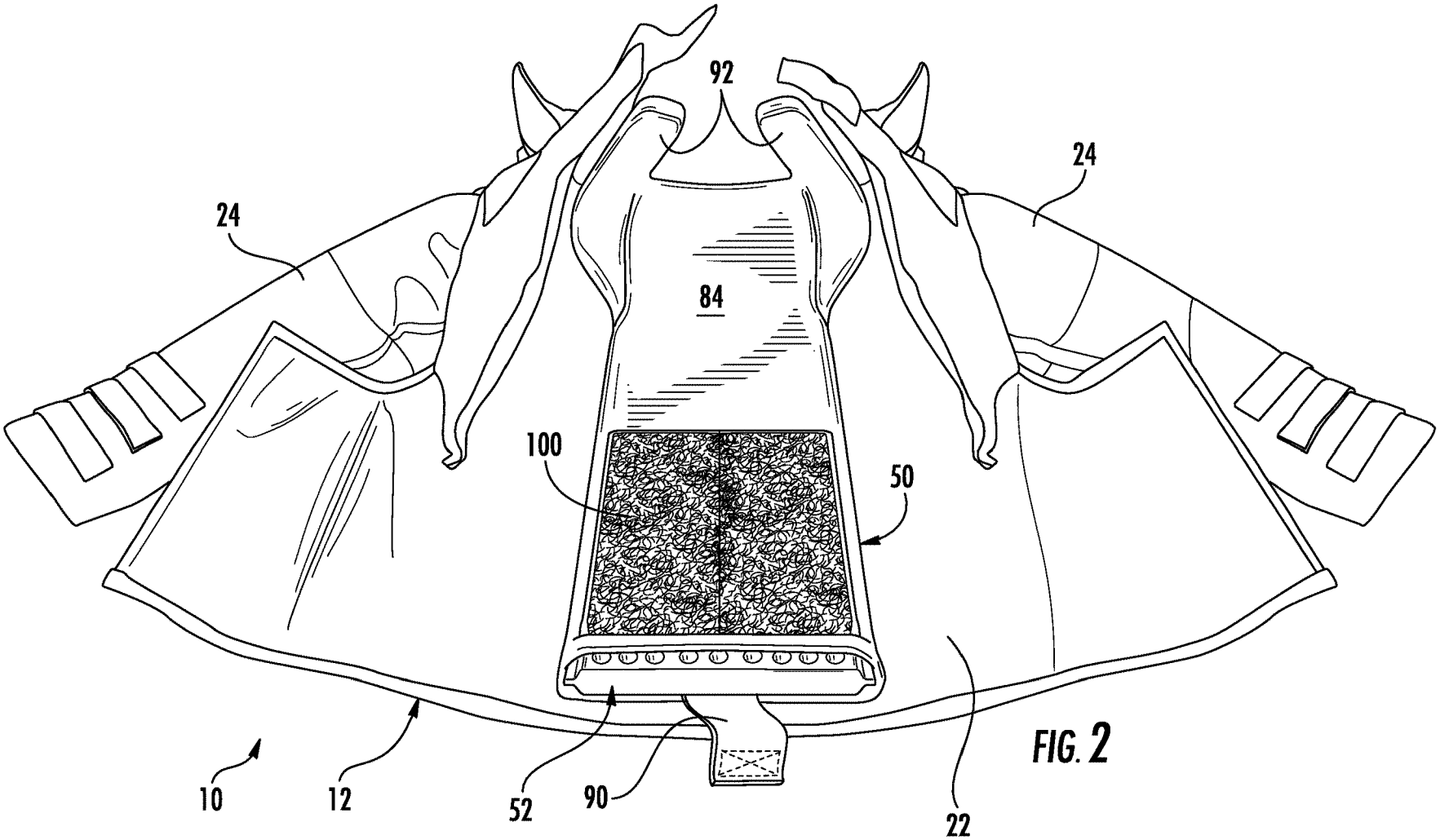
FIG. 2 is a pictorial view illustrating the jacket laid open with the back protector on the jacket and parts of the back protector removed for clarity.
Figure 5:
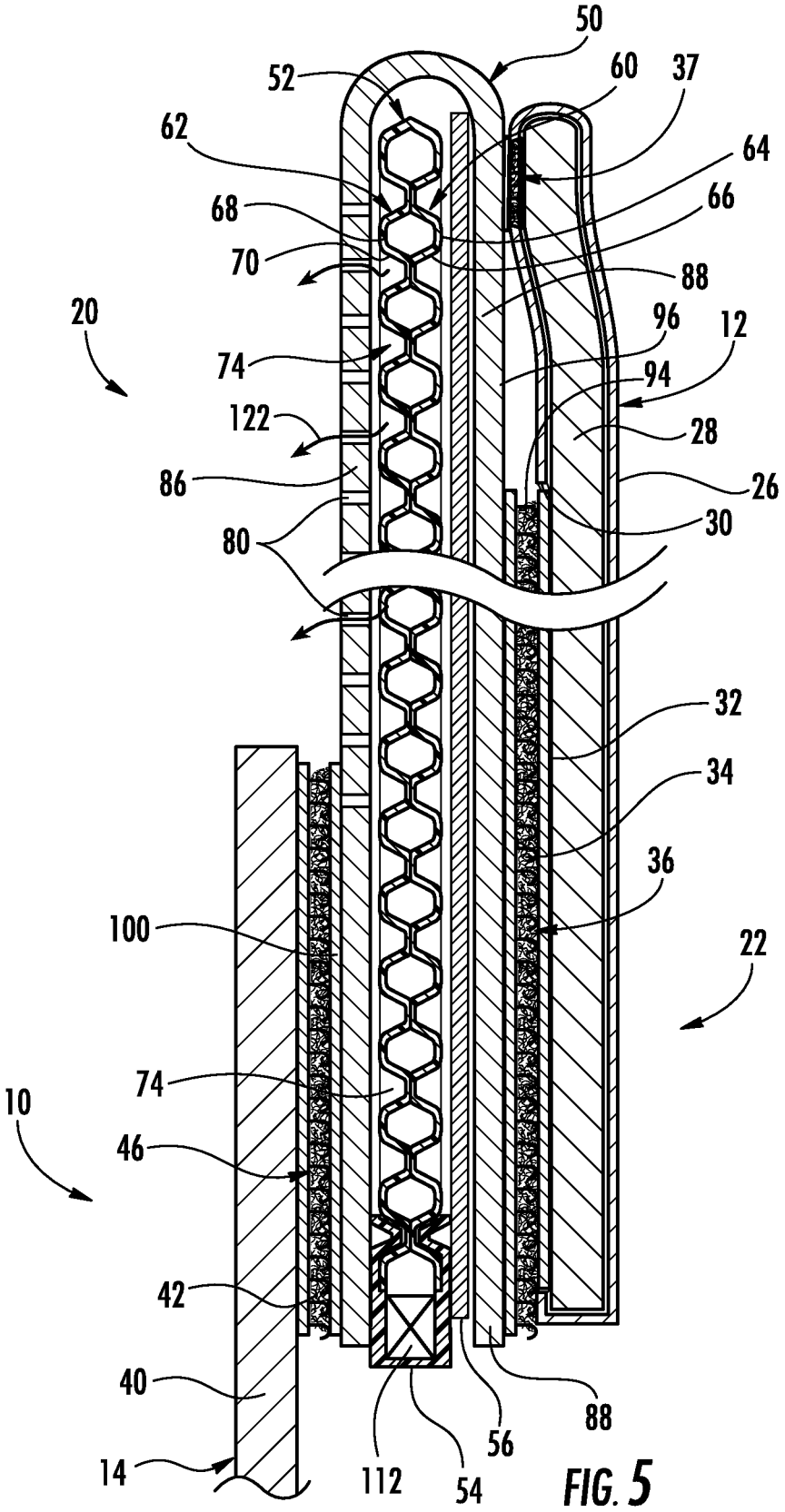
FIG. 5 is a schematic sectional view illustrating the arrangement of the parts of the suit when the back protector is in place.
Figure 7:
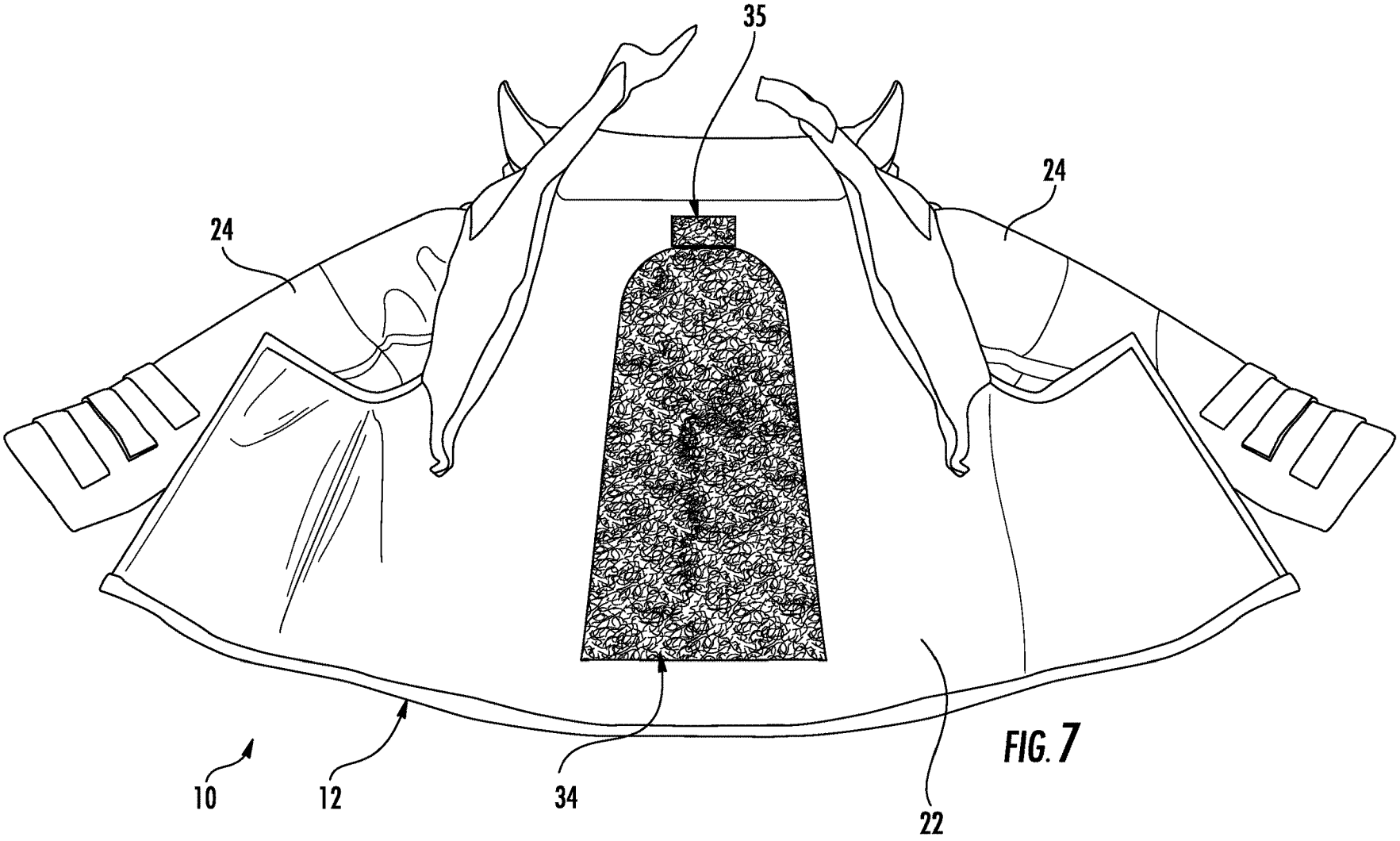
FIG. 7 is a pictorial view similar to FIG. 2 illustrating the jacket laid open and without the back protector in place.

The jacket 12 (FIGS. 1, 2 and 7) has a torso section 22 and two sleeves 24. The torso section of the jacket 12 has a multilayered construction including an internal body or layer 28 (FIG. 5) of protective material, for protection against blast effects, that is contained within a shell or outer layer or covering 26 (FIG. 5). As can be seen in FIG. 5, part of the outer covering 26 of the back panel of the torso section 22 of the jacket 12, facing the wearer's torso, is cut away to provide an opening 30 that exposes an inner surface 32 of the protective material unit 28.

Figure 4:
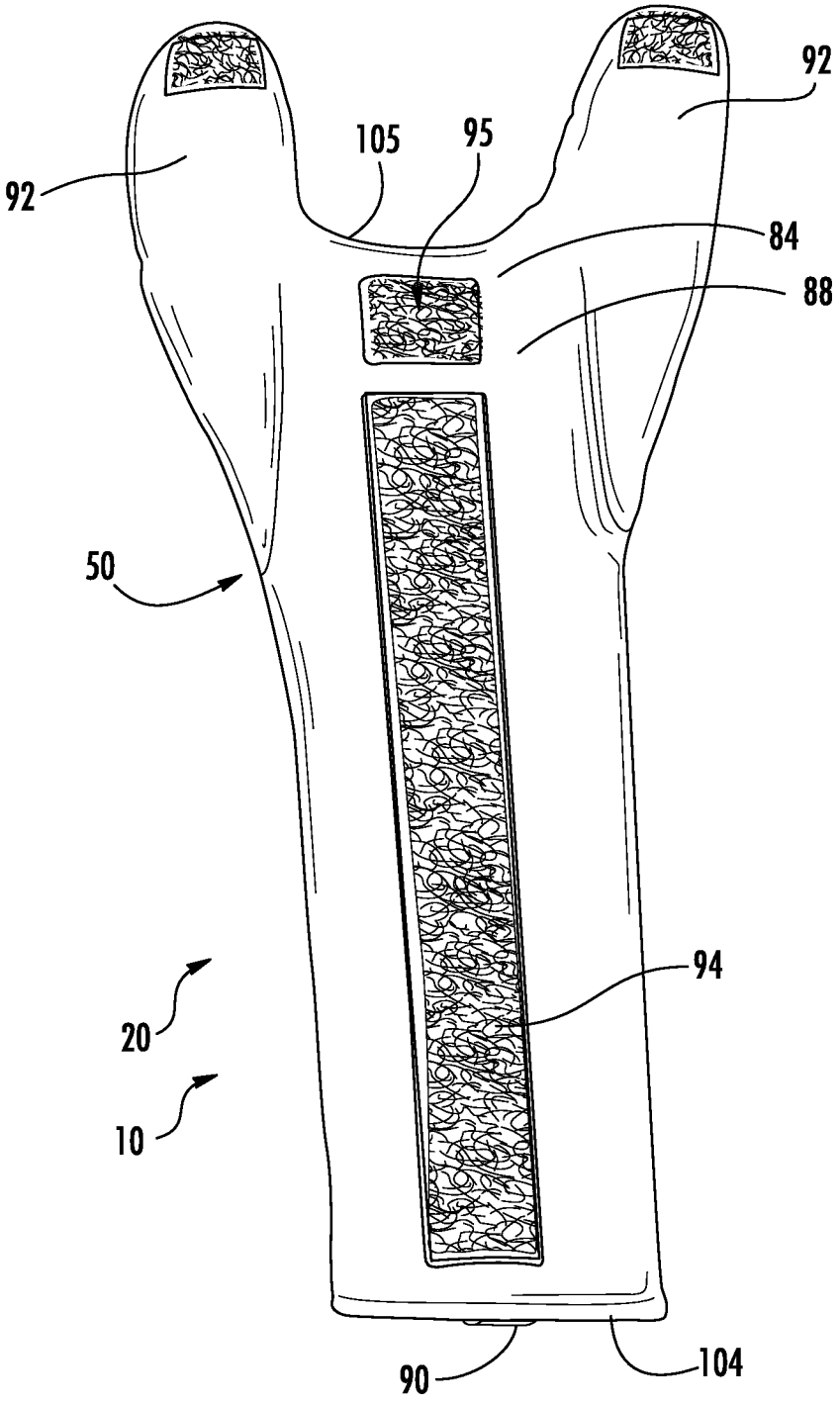
FIG. 4 is an elevational view showing the opposite side of the cover.

A hook and loop connector patch 34 on the jacket 12 (FIGS. 4, 5 and 7) (e.g., Velcro brand material) is fixed on the inner surface 32 of the protective material unit 28, facing the wearer. The patch 34 on the jacket 12 is part of a lower jacket connector 36, which as described below releasably connects the jacket with the cover 50 in a force-transmitting relationship. The patch 34 constitutes the jacket portion of the lower jacket connector 36. The patch 34 is engageable, as described below, with a patch 94 on the cover 50 of the back protector 20; the patch 94 forms the other part of the lower jacket connector 36. The patch 34 is preferably about 11 inches wide and extends vertically from about 6 inches just below the collar to a location close to the hem of the jacket 12.

A second hook and loop connector patch 35 on the jacket 12 (FIGS. 4, 5 and 7) (e.g., Velcro brand material) is fixed on the outer covering 26 of the torso section of the jacket, facing the wearer. The patch 35 on the jacket 12 is part of an upper jacket connector 37, which, together with the lower jacket connector 36, releasably connects the jacket with the cover 50 in a force-transmitting relationship. The patch 35 constitutes the jacket portion of the upper jacket connector 37. The patch 35 is engageable, as described below, with a patch 95 on the cover 50 of the back protector 20; the patch 95 forms the other part of the upper jacket connector 37. The patch 35 is preferably about 4 inches wide and extends 2 inches vertically from just below the collar of the jacket 12.

The waistband area 40 of the trousers 14 (FIG. 5) is at the upper end of the trousers. The length of the jacket 12 is selected to ensure that the jacket hem overlaps the waistband area 40 of the trousers 14. Another hook and loop connector patch 42 is fixed on the outer back side of the waistband section 40 of the trousers 14, facing away from the wearer. The patch 42 is part of a trousers connector 46, which as described below releasably connects the trousers 14 with the back protector 20 in a force-transmitting relationship. The patch 42 constitutes the trouser portion of the lower jacket connector 46. The patch 42 on the trousers 14 is engageable, as described below, with a patch 100 (FIGS. 3 and 5) on the cover 50 of the back protector 20, to complete the trousers connector 46.

The back protector 20, as noted above, includes four major elements: a cover 50, a body of impact resistant material 52, a fan assembly 54, and a back plate 56. The back plate 56 (FIGS. 3 and 5) is an element of the back protector 20 that provides impact protection for the wearer's spinal area. The back plate 56 is located inside the cover 50, adjacent to the outer panel 58 (FIG. 3) of the cover. The back plate 56 provides a significant portion of the overall impact resistance of the back protector 10, as it spreads the force of any small area impact over a larger surface area. The back plate 56 also has a structural function within the back protector 20, that is, to support the other elements of the back protector. Specifically, the back plate 56 is rigid enough to help to support the body of impact resistant material 52 in the desired configuration and at the desired location along the back of the wearer, when the cover 50 is secured in place between the jacket 12 and the trousers 14. The back plate 56 is flexible enough to allow a wearer to move normally while wearing the suit 10, including bending of the torso.

Figure 8A:
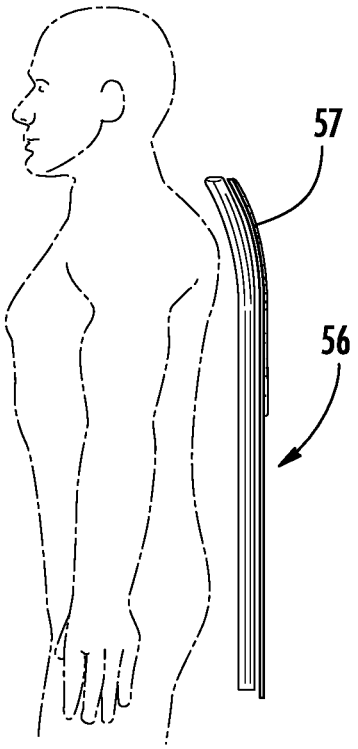
FIG. 8A is a schematic side view of a portion of the back protector showing the curvature of the back plate.
Figure 8B:
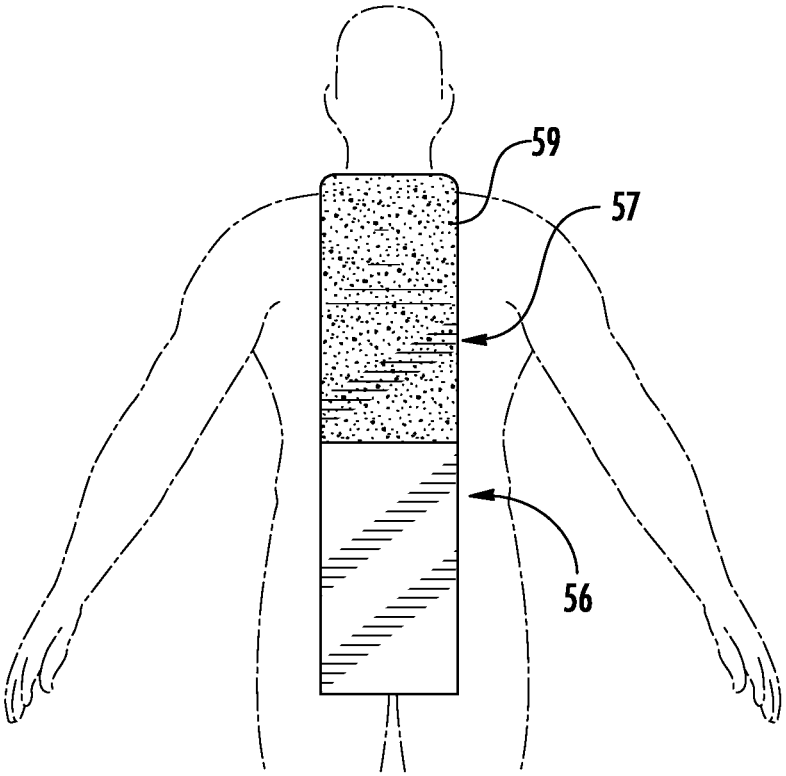
FIG. 8B is a schematic back elevational view of the back plate.

The back plate 56 (FIGS. 8A and 8B) is preferably curved at its upper portion 57, to follow the forward curvature of the spine in the thoracic region. This curvature is, for clarity, not shown in FIG. 5. This curvature eliminates the need to make the jacket 12 oversized in that area to accommodate a planar, vertical back plate.

Various different materials can be used for the back plate 56, for example, a composite material, for example a thermoplastic composite material. In one embodiment, the back plate is about 8.25 inches wide and 0.125 inches thick. An optional carbon fiber sheet 59, about 0.04 inches thick, may be attached to the outer (convex) surface of the upper portion 57 of the back plate 56. The carbon fiber sheet 59 is inflexible and may help to preserve the needed curvature of the upper portion of the back plate during storage and use, if necessary. This sheet 59 is represented also schematically in FIGS. 8A and 8B.

The back plate 56 is able to transmit load vertically along the length of the back protector 20. The back plate 56 is substantially more rigid in this aspect than the body of impact resistant material 52. As a result, and as described below in detail, the back plate 56 can transmit a significant portion of the load (weight) of the jacket 12 vertically downward into the trousers 14, to relieve the burden on the wearer's shoulders.

The body of impact resistant material 52 (FIGS. 5 and 6) is located inside the back protector cover 50, between the back plate 56 and the inner panel 86 of the cover. A wearer of a bomb disposal suit such as the suit 10 is instructed to face a blast, in which case the blast force will push the wearer from the front, and the wearer will fall on his back. The impact resistant material 52 is chosen from the class of materials that can provide the level of impact protection needed to help protect a wearer of the suit 10 in such a situation. The impact resistant material 52 is chosen primarily for its impact resistance rather than, for example, penetration resistance. It must reduce impact force on the wearer in such a situation to an acceptable level.

In this regard, bomb disposal suits are manufactured to meet certain NIJ (National Institute of Justice) standards, for protection of the wearer. The relevant NIJ standard is No. 0117 Public Safety Bomb Suit Standard that specifies certain impact resistance requirements for a bomb disposal suit. The current version of this standard contains a spine protection requirement in which the maximum force value transmitted shall not exceed 4 kN (four kilo-Newtons) upon performance of a certain sphere drop test. This Standard is available and described online at the U.S. Department of Justice, Office of Justice Programs, website at https://www.ncjrs.gov/pdffiles1/nij/227357.pdf, and at other locations.

The NIJ standards provide certain specific shapes such as anvils whose energy must be attenuated to below certain levels of transmitted force/energy to the underlying body tissue of the wearer. Thus, the impact protection material is not simply a comfort padding that may provide some minimal level of bump or impact protection. A material such as the ballistic fabric typically found in ballistic vests, although it does provide some impact protection per se, is not really suitable for this application. Foam-like materials are characterized by a steep increase in their stress-strain curve when they reach a certain level of compression, at which point their impact attenuation efficiency decreases significantly.

In the illustrated embodiment, the impact resistant material 52 is a flexible plastic cushioning material that is resilient, and, when configured as described herein, exhibits high enough impact resistance to help the suit 10 to meet the NIJ standard. Such material is available in various different configurations, including the one particular configuration that is illustrated herein as being preferred but not as being limiting.

The body of impact resistant material 52 in the illustrated embodiment is made from two layers 60 and 62 of material that are bonded together. The first or outer layer 60 has a main wall 64, and a series of projections 66 that are in the shape of domes or cones, with air space between the projections. In the illustrated embodiment, the material has a wall thickness of about 0.04 inches. The cones 66 have a height of about 0.5 inches and a diameter at their widest point of about 0.6 inches. The cones 66 may be located, as illustrated, in a regular array of rows and columns, on the main wall 64, at a center to center spacing of about 0.875 inches.

The second or inner layer 62 of impact resistant material is similar in makeup to the first layer 60. The second layer has a main wall 68 and a series of cone shaped projections 70, with air space between the projections.

The two material layers 60 and 62 (FIGS. 5 and 6) are bonded together with the projections 66 and 70 facing each other and their small ends abutting. This forms a large number of hourglass shapes that can be compressed along their length between the flat layers of the main walls 64 and 68, absorbing energy in the process. When this compression occurs, any remaining force is dispersed over a wider area. The stiffer main walls 64 and 68 are on the outside of the two layer construct. As a result, an air chamber or plenum 74 is formed between the main wall 64 of the outer layer 60 and the main wall 68 of the inner layer 62. The plenum 74 includes the spaces between and among the cones 66 and 70.

The two material layers 60 and 62 are bonded together along their long side edges 76. A number of air outlet pores 78 are formed in those bonded edges 76, to allow air to flow out of the plenum 74 at the sides of the body of impact resistant material 52. In addition, a large number of air outlet pores 80 are formed in the main wall 68 of the inner layer 62. The pores 80 allow air to flow out of the plenum 74 along the inner side of the body of impact resistant material 52. Together, all the air outlet pores 78 and 80 and in the impact resistant material 52 constitute an air outlet of the impact resistant material 52, which is an air outlet of the back protector 10.

The joining of the two layers of material 60 and 62 in this manner provides a resilient, highly impact resistant structure. Specifically, the cone-shaped projections 66 and 70 on the material layers 60 and 62 deform under force that is applied in a direction normal to the plane of the back protector 10. In addition, the material itself is impact resistant. With the two layers 60 and 62 bonded together as described, and in the event of an impact on the back protector 10, the two layers form a resilient structure that physically absorbs impact force and resists transmission of that force to the opposite side of the body of impact resistant material 52.

The cover 50 (FIGS. 3-5) extends around and covers the other elements of the back protector, except a portion of the fan assembly 54. The cover 50 is preferably made from a fabric-type material, such as Cordura® brand fabric.

The cover 50 is shaped as a closed sleeve with an elongate configuration that extends from the wearer's shoulders down to the waist. A main body portion 84 of the cover 50 is generally rectangular in configuration. The main body portion 84 of the cover 50 includes an inner panel 86 (closer to the wearer) and an outer panel 88 (closer to the jacket 12), between which are located the back plate 56 and the body of impact resistant material 52. The inner panel 86 of the cover 50, which faces the torso of the wearer when the suit is being worn, is porous at selected areas to allow ventilating air to flow through.

The cover 50 is open at the bottom to enable removal and/or replacement of the other parts of the back protector 10. A strap 90 extends from the bottom end of the cover 50 to extend over and secure the other parts of the back protector 20 within the cover.

Figure 3:
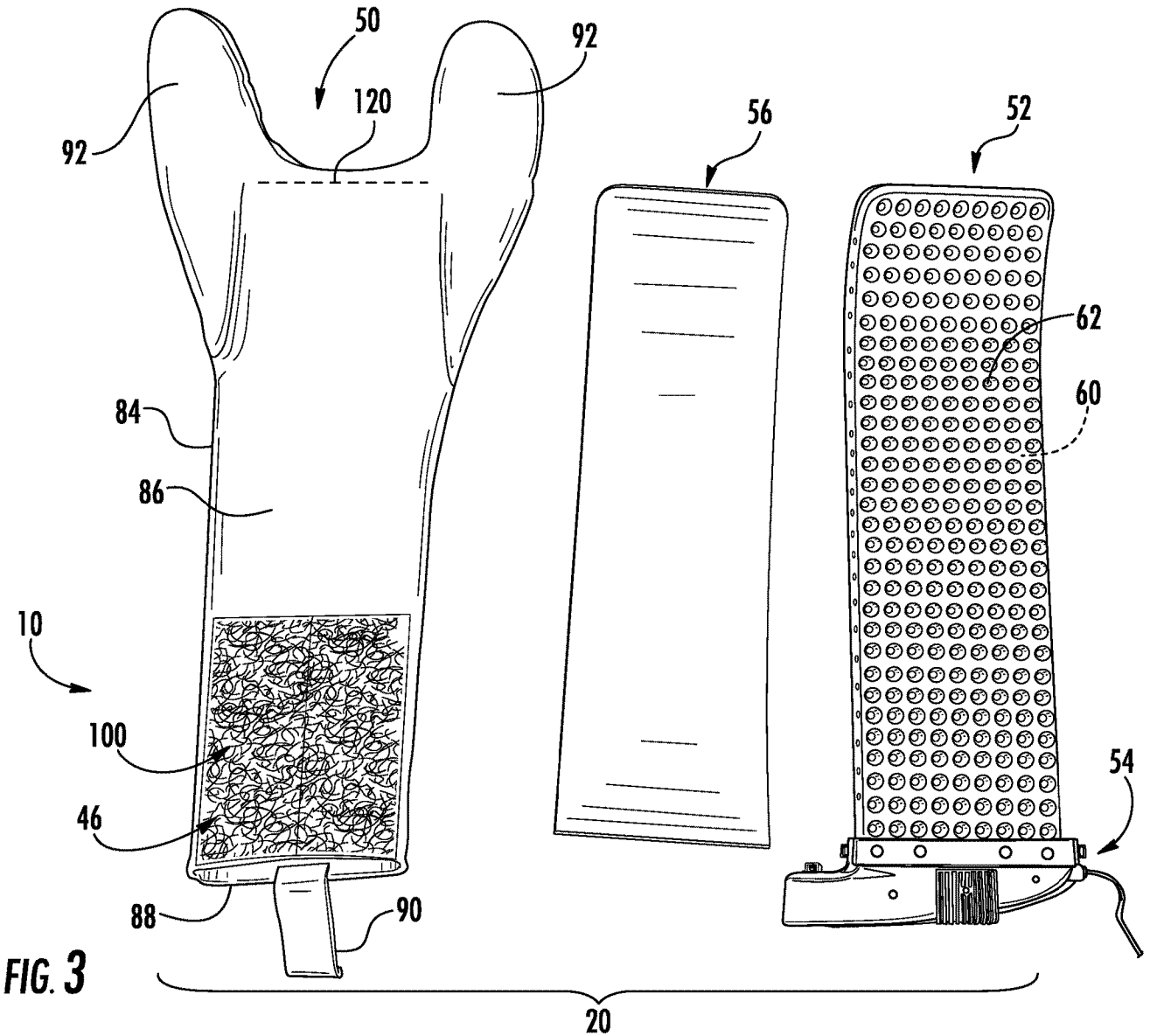
FIG. 3 is an exploded view of the component parts of the back protector including a cover, a back plate, a body of impact resistant material, and a fan assembly.

At the upper end of the main body portion 84 of the cover 50, the cover widens out and forms two ears 92 that extend over the wearer's shoulders. The ears 92 may have hook and loop patches as shown to help secure in place the upper end portion of the cover 50 of the back protector 20, inside the jacket 12. A layer of foam padding about one inch thick is preferably located inside the ear portions 92 of the cover 50, which sit on the wearer's shoulders. The cover 50 is sewn shut below the ears, along the bottom edge of the U-shaped opening that is formed between the ears, by means of a stitching section or seam 120 (FIG. 3).

The cover 50 include three hook and loop connector patches that engage the two patches 34 and 35 on the jacket 12 and the patch 42 on the trousers 14. The first on of these three patches is a cover portion 94 (FIGS. 4, 5 and 7) of the lower jacket connector 36. The cover portion 94 of the lower jacket connector 36 is, in the illustrated embodiment, a hook or loop connector patch. The patch 94 is located on the outer major side surface 96 of the outer panel 88 of the cover 50, facing away from the wearer. The patch 94 is preferably about 4 inches wide and extends vertically from the edge 104 to a location about 5 inches from the edge 105. The cover portion 94 of the lower jacket connector 36 is engageable, in a manner described below, with the patch 34 on the jacket 12, to releasably connect the cover 50, and thus the back protector 20, with the jacket.

The second connector patch on the cover 50 is a cover portion 95 (FIGS. 4, 5 and 7) of the upper jacket connector 37. The cover portion 95 of the upper jacket connector 37 is, in the illustrated embodiment, a hook or loop connector patch. The patch 95 is located on the outer major side surface 96 of the outer panel 88 of the cover 50, facing away from the wearer. The patch 95 is preferably about 4 inches wide and extends starting 1 inch from the edge 105 vertically for about 2 inches. The cover portion 95 of the upper jacket connector 37 is engageable, in a manner described below, with the patch 35 on the jacket 12, to releasably connect the cover 50, and thus the back protector 20, with the jacket The third connector patch on the cover 50 is a cover portion 100 (FIGS. 3 and 5) of the trousers connector 46. The cover portion of the trousers connector 46 is, in the illustrated embodiment, a hook or loop connector patch 100. The patch 100 is located on the outer major side surface of the inner panel 86 of the cover 50. The patch 100 is preferably about 8 inches wide and extends to a location just above the bottom end of the cover 50, facing toward the wearer. The cover portion 100 of the trousers connector 46 is engageable, in a manner described below, with the patch 42 on the trousers 14.

The body of impact resistant material 52 (FIG. 5) is assembled inside the cover 50 along with the back plate 56. The back plate 56 is to the outside, against the outer panel 88 of the cover 50. The body of impact resistant material 52 is to the inside of the back plate 56, against the inner panel 86 of the cover 50. The back plate 56 helps to maintain the cover 50 and the body of impact resistant material 52, both of which are relatively flexible, in a more inflexible or rigid condition.

The fan assembly 54 (FIG. 6) includes a housing 110 that supports an electrically powered fan 112. A rectangular duct 114 extends from the housing 110 and is connected with the body of impact resistant material 52. The walls of the duct 114 have a number of projections that fit into the cones 66 and 70 at the lower end of the body of impact resistant material 52, to clamp the fan assembly 54 to the body of impact resistant material.

The dimensions of the several parts of the back protector 20 are selected so that the back plate 56 and the body of impact resistant material 52 are contained within the cover 50 with virtually no movement allowed. Specifically, the length of the back plate 56 and of the body of impact resistant material 52 are selected to fit closely inside the main body portion 84 of the cover 50. The upper end of the main body portion 84 of the cover 50 is sewn shut at the bottom of the U-shaped opening between the ears 92, at the seam 120. The upper end of the back plate 56 abuts this seam 120. At the lower end of the cover 50, the strap 90 is closed tightly over the fan assembly 54, lifting it up into the interior of the cover. The lower end of the back plate 56 also is held up by the strap 90. As a result, the back plate 56 is firmly held in the cover 50 against lengthwise (vertical) movement within the cover. In addition, the width of the back plate 56 and the width of the body of impact resistant material 52 are selected to eliminate any significant lateral movement inside the cover 50.

After the back protector 20 is fully assembled, it is connected with the jacket 12 first, and then with the trousers 14. The back protector 20 is positioned on the inside of the jacket 12 by engaging the upper jacket connector 37. This engagement ensures that the back protector is properly positioned high enough on the jacket 12 to provide the required protection for the cervical and thoracic spine. With the jacket 12 and the back protector in this condition, the lower jacket connector 36 is then engaged. After the trousers 14 are donned, the jacket 12 is donned, together with the back protector 50, and the trousers connector 46 is engaged. As a result, the jacket 12, the back protector 20, and the trousers 14 are fully interconnected.

The back protector 20 is able to transmit vertical load between the jacket 12 and the trousers 14, in the following manner. An upper area of the back protector 20 is secured to the jacket via the lower jacket connector 36, at about the location of the small of the back. A lower area of the back protector 20 is secured to the trousers 14 via the trousers connector 46. The back protector 20 is thereby releasably connected in a force-transmitting relationship between the jacket 12 and the trousers 14. As a result, vertical load (weight) from the jacket 12 is transmitted downward through the back protector 20 into the trousers 14. The back protector 20 thus removes some or substantially all of the load on the shoulders of the wearer, as desired.

When the bomb disposal suit 10 is worn, the back plate 56 and the body of impact resistant material 52 provide the needed impact resistance for the spinal area of the wearer, in the event of a force such as a bomb blast on the front of the wearer that throws the wearer backward onto the wearer's back. The harder material of the back plate 56, more directly engaging the impact, distributes the force to the softer impact resistant material 52, which conforms to the wearer's back and further cushions the impact. The hourglass shapes in the body of impact resistant material 52 are compressed along their length between the harder flat layers of the main walls 64 and 68. As this occurs, any remaining force is dispersed over a wider area.

When the bomb disposal suit 10 is worn, the back protector 20 also provides ventilation and cooling to the wearer of the bomb disposal suit 10. The fan 112, when actuated, pulls air into the fan housing 110 and directs the air out of the housing, through the duct 114, into the plenum 74 that is located between the two panels 60 and 62 of impact resistant material 52. The ventilating air flows through the plenum 74, in a vertically upward direction. The ventilating air exits the body of impact resistant material 52 through the air outlet pores 80 in the inner major side surface of the body, in a direction indicated by the arrows 130 in FIG. 6. The ventilating air flows through the porous inner panel 86 of the cover 50 to contact and cool the back of the wearer. Thus, the ventilation is directed at relevant areas where the body most needs cooling, as opposed to being dispersed over the entire suit. The pores 80 provide small jets of air that impact the wearer, rather than a wider open channel of air that flows over a region of the wearer's skin. Ventilation is provided mostly at the back level, and sides of the chest.

Figure 6:
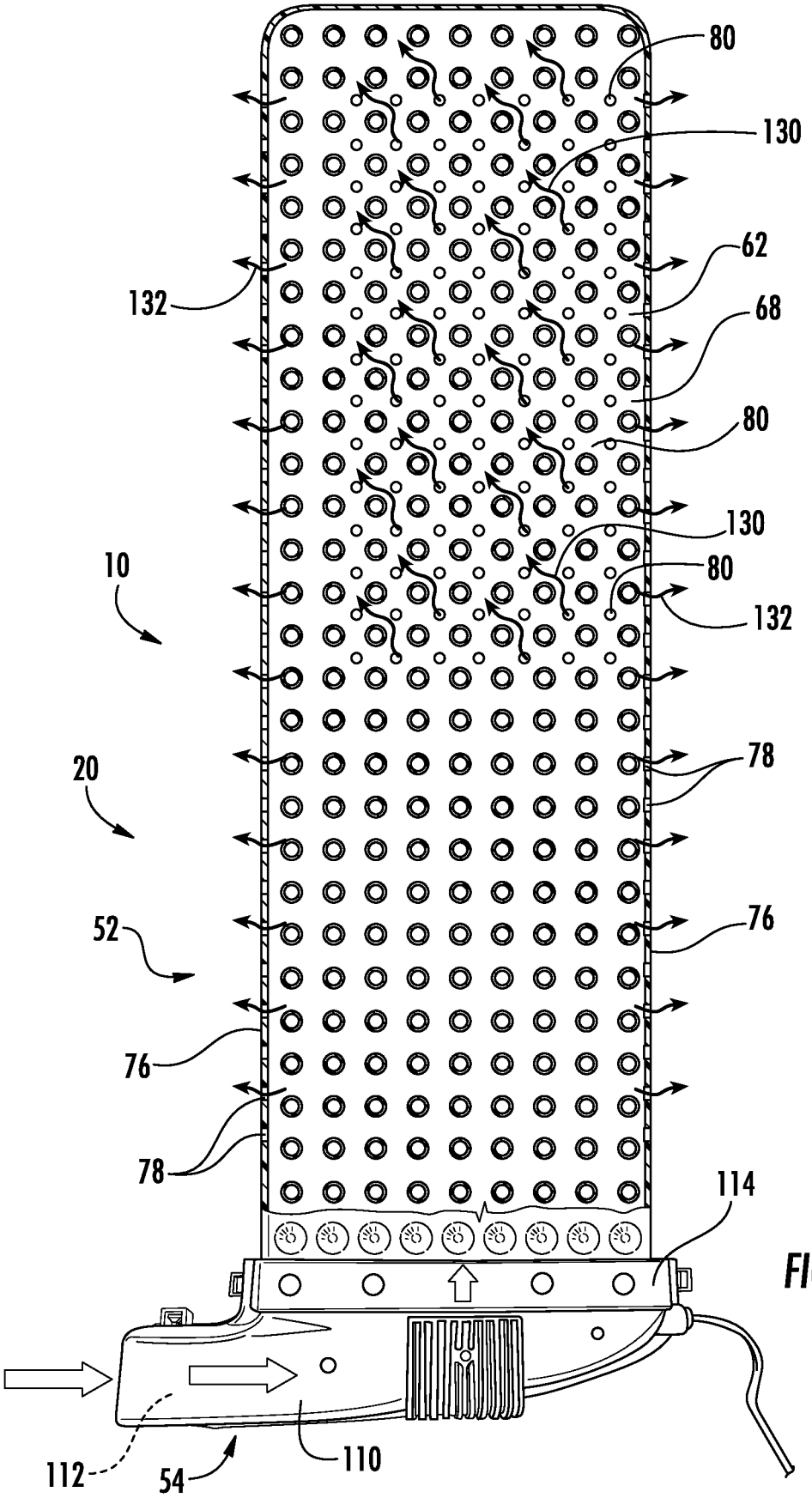
FIG. 6 is an elevational view illustrating schematically the flow of ventilating air from the body of impact resistant material.

A small portion of the forced ventilating air also flows out of the secondary pores 78 in the side edges 76 of the body of impact resistant material 52, in a direction indicated by the arrows 132 in FIG. 6. These pores 78 on the side edge 76 of the body of impact resistant material 52 can act as a relief valve for the forced air if, for example, the wearer of the suit is disabled and lying on his back with the fan 112 still running.

The presence of the plenum 74, an integral part of the body of impact resistant material 52, means that there is no need for additional tubing specifically for the purpose of ventilation. The presence and availability of the plenum 74 also attest to the high ratio of impact attenuation to weight for the body of impact resistant material 52. Lighter weight in the bomb disposal suit 10 is a strongly desired characteristic. Being able to provide the high levels of impact resistance, and also ventilation, in a light weight structure, is very beneficial.

From the foregoing description, those skilled in the art will perceive improvements, changes, and modifications in the invention. Such improvements, changes, and modifications within the skill of the art are intended to be covered by the appended claims.

The invention claimed is:

1. A bomb disposal suit comprising:

a jacket;

trousers; and a back protector connected between the jacket and the trousers;

the back protector including a body of impact resistant material;

the body of impact resistant material having a plenum with an intake opening to receive forced air and with outlet openings to direct forced air out of the plenum; and the back protector including a fan that forces air into the intake opening, wherein the body of impact resistant material comprises a first layer and a second layer that are bonded to each other to form between them an array of resiliently compressible elements that define between them the plenum, and wherein the fan has an outlet that is connected in fluid communication with the plenum, and the outlet opening comprises a number of outlet openings in one of the first and second layers that is presented toward the wearer's back.

2. A bomb disposal suit as set forth in claim 1 wherein the back protector is connected in a force transmitting relationship between the jacket and the trousers.

3. A bomb disposal suit as set forth in claim 1, wherein the back protector further includes a back plate that is substantially more rigid than the body of impact resistant material and that transmits vertical load from the jacket into the trousers.

4. A bomb disposal suit as set forth in claim 3 wherein the back protector includes a cover that closely encloses the back plate and the body of impact resistant material, the cover including fastener portions that releasably connect the cover to the jacket and the trousers to transmit vertical load from the jacket through the back plate into the trousers.

5. A bomb disposal suit comprising:

a jacket;

trousers; and a back protector worn inside the jacket;

the back protector including a body of impact resistant material;

the body of impact resistant material having a plenum with an intake opening to receive forced air and with an outlet opening to direct forced air out of the plenum;

the back protector including a fan that forces air into the intake opening; and the back protector including a back plate that supports the body of impact resistant material inside the jacket wherein the back protector includes a cover that encloses the back plate and the body of impact resistant material, and that is releasably fastened to the jacket and to the trousers.

6. A bomb disposal suit as set forth in claim 5 wherein the back protector is connected in a force-transmitting relationship between the jacket and the trousers and the back plate transfers load vertically along the back protector.

7. A bomb disposal suit as set forth in claim 5 wherein the suit includes a first releasable fastener connecting an upper portion of the back protector and the jacket, and a second releasable fastener connecting a lower portion of the back protector and the trousers.

8. A bomb disposal suit as set forth in claim 7 wherein each one of the first and second releasable fasteners comprises a hook and loop fastener.

9. A bomb disposal suit comprising:

a jacket;

trousers; and a back protector worn inside the jacket;

the back protector including a body of impact resistant material;

the body of impact resistant material having a plenum with an intake opening to receive forced air and with an outlet opening to direct forced air out of the plenum;

the back protector including a fan that forces air into the intake opening; and the back protector including a back plate that supports the body of impact resistant material inside the jacket, wherein the back plate is more rigid than the body of impact resistant material, and is closely fitted with the body of impact resistant material in a cover, and the cover is releasably fastened to the jacket and to the trousers.

10. A bomb disposal suit comprising:

a jacket;

trousers; and a back protector worn inside the jacket;

the back protector including a body of impact resistant material;

the body of impact resistant material having a plenum with an intake opening to receive forced air and with an outlet opening to direct forced air out of the plenum;

the back protector including a fan that forces air into the intake opening; and the back protector including a back plate that supports the body of impact resistant material inside the jacket, wherein the body of impact resistant material comprises a first layer and a second layer that are bonded to each other to form between them an array of resiliently compressible elements that define between them the plenum, and wherein the fan has an outlet that is connected in fluid communication with the plenum, and the outlet opening comprises a number of outlet openings in one of the first and second layers that is presented toward the wearer's back.

11. A bomb disposal suit comprising:

a jacket;

trousers; and a back protector worn inside the jacket;

the back protector including a body of impact resistant material;

the body of impact resistant material having a plenum with an intake opening to receive forced air and with an outlet opening to direct forced air out of the plenum;

the back protector including a fan that forces air into the intake opening; and the back protector including a back plate that supports the body of impact resistant material inside the jacket, wherein the body of impact resistant material comprises a first layer of resilient material and a second layer of resilient material that are bonded to each other to define between them the plenum, and wherein the fan has an outlet that is connected in fluid communication with the plenum to direct air into the plenum, and the outlet opening comprises a number of outlet pores in one of the first and second layers that is presented toward the wearer's back.

12. A bomb disposal suit comprising:

a jacket;

trousers; and a back protector worn inside the jacket;

the back protector including a body of impact resistant material;

the body of impact resistant material having a plenum with an intake opening to receive forced air and with an outlet opening to direct forced air out of the plenum;

the back protector including a fan that forces air into the intake opening; and the back protector including a back plate that supports the body of impact resistant material inside the jacket, wherein the body of impact resistant material comprises a flexible plastic material and the back plate comprises a composite material.

* * * * *